US010856386B2

(12) United States Patent
Wen et al.

(10) Patent No.: US 10,856,386 B2
(45) Date of Patent: Dec. 1, 2020

(54) LED DRIVER CIRCUIT AND LED LIGHTING DEVICE THEREOF

(71) Applicant: XIAMEN ECO LIGHTING CO. LTD., Xiamen (CN)

(72) Inventors: Shuisheng Wen, Xiamen (CN); Liping Lin, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/798,278

(22) Filed: Feb. 21, 2020

(65) Prior Publication Data

US 2020/0196415 A1 Jun. 18, 2020

Related U.S. Application Data

(63) Continuation-in-part of application No. 16/671,735, filed on Nov. 1, 2019.

(60) Provisional application No. 62/754,054, filed on Nov. 1, 2018.

(51) Int. Cl.
*H05B 45/382* (2020.01)
*H05B 45/325* (2020.01)

(52) U.S. Cl.
CPC ..... *H05B 45/382* (2020.01); *H05B 45/325* (2020.01)

(58) Field of Classification Search
CPC .. H05B 45/382; H05B 45/325; H05B 45/345; H05B 45/37; H05B 45/375; H05B 47/10; H05B 47/105
See application file for complete search history.

(56) References Cited

U.S. PATENT DOCUMENTS

2010/0026208 A1* 2/2010 Shteynberg ..... H05B 33/08 315/297

* cited by examiner

*Primary Examiner* — Henry Luong
(74) *Attorney, Agent, or Firm* — Chun-Ming Shih; Lanway IPR Services

(57) ABSTRACT

A LED driver circuit includes a first voltage drop module, a constant current driving module, a second voltage drop module, a DIP switch module, an auxiliary winding module, a control module and a loading module. The loading module is driven by converting a direct current voltage. The converted direct current voltage is additionally bucked to generate an optimized voltage that powers the DIP switch module and the control module. The DIP switch module selects a level of a predetermined current and in turn outputs an electrical signal to the control module. Therefore, the control module outputs a corresponding pulse signal for regulating a current passing through the loading module. Meanwhile, the control module calculates a required voltage level for driving. And the control module compares the required voltage level with an actual voltage value output by the auxiliary winding module and then determines the working status of the loading module.

3 Claims, 4 Drawing Sheets

LED DRIVER CIRCUIT AND LED LIGHTING DEVICE THEREOF

FIELD OF THE INVENTION

The present invention relates to electronic circuitry, and more particularly, to a LED driver circuit and a LED lighting device utilizing the LED driver circuit.

BACKGROUND

A conventional light apparatus, more specifically, a LED apparatus, is more likely driven via a constant current output. And its output current is constant. Also, its output voltage matches the LED light apparatus's input voltage requirements. Its output power decreases in proportional to the LED apparatus's input voltage. When its driving output voltage is lower, its driving power is correspondingly lower. And it significantly limits the LED apparatus's driving function. In other words, the conventional LED apparatus's driving function is significantly limited because of a lower driving power that comes from a smaller driver output voltage.

SUMMARY OF THE INVENTION

The present invention aims at disclosing a LED driver circuit and a driver device that relieve the conventional LED apparatus of its significantly limited driving functions caused by when it confronts a lower driving output voltage and in turn a lower driving power.

First, the present invention discloses a LED driver circuit that includes a first voltage drop module, a constant current driving module, an auxiliary winding module, a second voltage drop module, a DIP switch module, and a control module. The first voltage drop module is connected to a power source. Also, the first voltage drop module converts the direct current voltage. The constant current driving module is connected to the first voltage drop module. In addition, the constant current driving module receives the converted direct current voltage for driving a loading module. The auxiliary winding module is connected to the first voltage drop module and the constant current driving module. Moreover, the auxiliary winding module receives the converted direct current voltage to output an actual voltage value for driving. The second voltage drop module is connected to the first voltage drop module. Besides, the second voltage drop module bucks the converted direct current voltage to output an optimized voltage. The DIP switch module is connected to the second voltage drop module. And the DIP switch module receives the optimized voltage, selects a predetermined current level, and outputs an electrical signal. The control module is connected to the DIP switch module, the second voltage drop module, the auxiliary winding module and the constant current driving module. The control module outputs a pulse signal to control that corresponds to the electrical signal for controlling the constant current driving module. The constant current driving module calculates the required voltage level and determines the working status of the loading module based on a voltage level relationship between the required voltage level and the actual voltage level.

Second, the present invention discloses a driver device that includes the loading module and the disclosed LED driver circuit. The disclosed LED driver circuit and the disclosed driver device include: a first voltage drop module, a constant current driving module, a second voltage drop module, a DIP switch module, an auxiliary winding module, a control module and a loading module. A direct current voltage is converted for driving a loading module. In addition, the converted direct current voltage is bucked to generate an optimized voltage that powers the DIP switch module and the control module. Moreover, the DIP switch module selects a level of a predetermined current and correspondingly outputs an electrical signal to the control module. In this fashion, the control module outputs a corresponding pulse signal for regulating a current passing through the loading module. Also, the control module calculates a required voltage level for driving. And the control module compares the required voltage level with the actual voltage value output by the auxiliary winding module for determining the working status of the loading module.

In this way, the disclosed driver circuit and the disclosed driver device regulate various levels of currents to drive various types of LED apparatuses. Also, they determine the output loading voltage to keep the output power constant. On top of that, the disclosed driver circuit and the disclosed driver device relieve the conventional LED apparatus of its significantly limited driving function introduced by a smaller driving output voltage and in turn a smaller driving power.

These and other objectives of the present invention will no doubt become obvious to those of ordinary skill in the art after reading the following detailed description of the preferred embodiment that is illustrated in the various figures and drawings.

DETAILED DESCRIPTION

The disclosed LED driver circuit and the disclosed driver device include a first voltage drop module, a constant current driver module, a second voltage drop module, a DIP switch module, an auxiliary winding module, a control module and a loading module. A direct current voltage is converted to drive a loading module. The converted direct current voltage is bucked to generate an optimized voltage that powers the DIP switch module and the control module. The DIP switch module selects a level of a predetermined current and in turn outputs an electrical signal to the control module. Such that the control module outputs a corresponding pulse signal for regulating a current passing through the loading module.

Meanwhile, the control module calculates a required voltage level for driving. Also, the control module compares the required voltage level with an actual voltage value output by the auxiliary winding module and in turn determines the working status of the loading module. In this fashion, the disclosed driver circuit and the disclosed driver device regulate various levels of currents to drive various types of LED apparatuses. In addition, they determine the output loading voltage to keep the output power constant.

Figure 1:
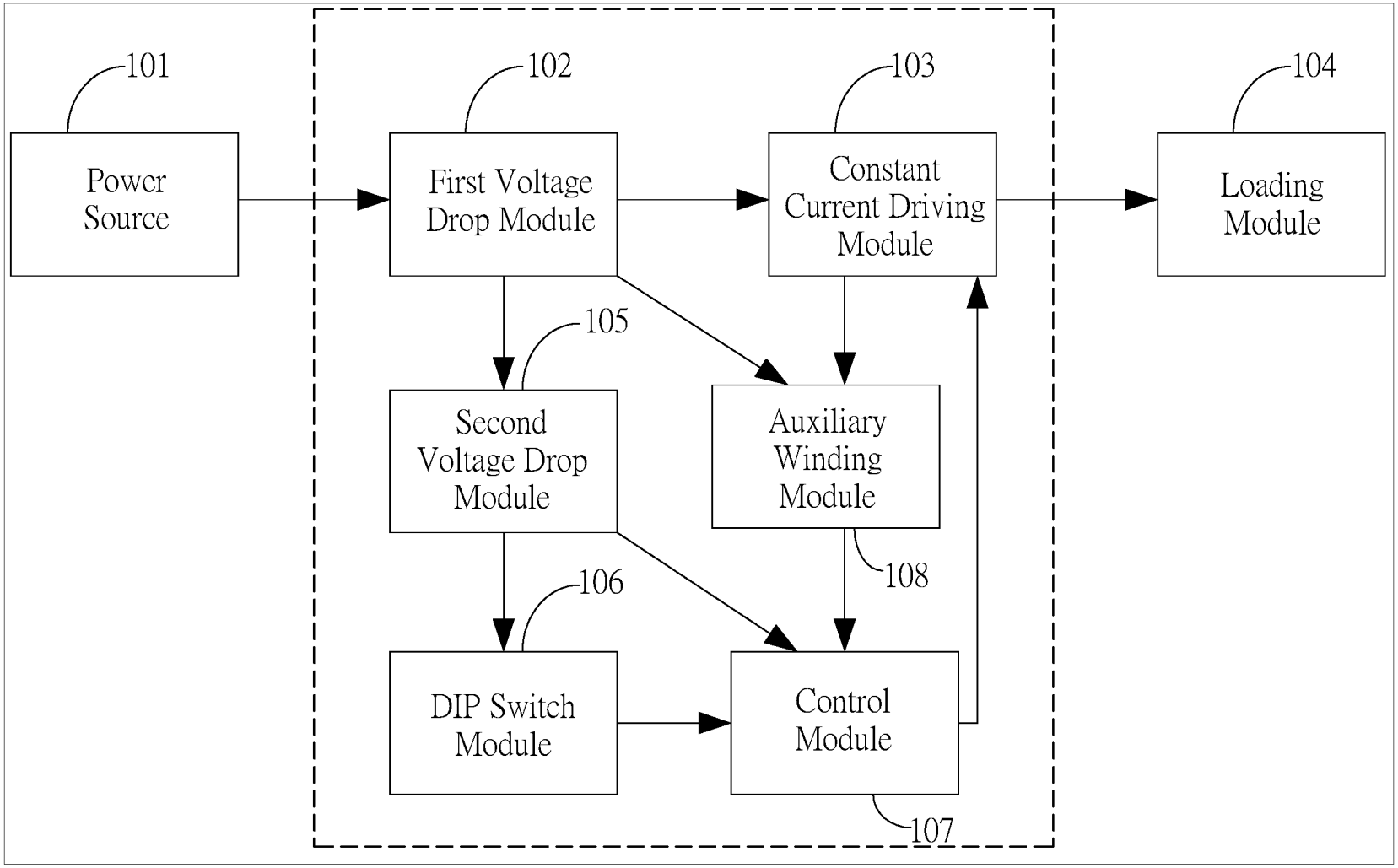
FIG. 1 illustrates a LED driver circuit's module structure according to one embodiment of the present invention.

FIG. 1 demonstrates a LED driver circuit's module structure according to one embodiment of the present invention. For clear explanation, only the parts related to the disclosed embodiment are shown. Detailed explanations are as follows:

The disclosed LED driver circuit includes a first voltage drop module 102, a constant current driving module 103, an auxiliary winding module 108, a second voltage drop module 105, a DIP switch module 106 and a control module 107.

The first voltage drop module 102 is connected to a power source 101 for converting a direct current voltage.

The constant driving module 103 is connected to the first voltage drop module 102 for receiving the converted direct current voltage that is then used for driving the loading module 104.

The auxiliary winding module 108 is connected to the first voltage drop module 102 and the constant driving module 103. And the auxiliary winding module 108 receives the converted direct current voltage and in turn outputs an actual voltage value for driving.

The second voltage drop module 105 is connected to the first voltage drop module 102. In addition, the second voltage drop module 105 bucks the converted direct current voltage and then outputs an optimized voltage.

The DIP switch module 106 is connected to the second voltage drop module 105. Moreover, the DIP switch module 106 receives the optimized voltage, selects a predetermined current level, and in turn outputs an electrical signal.

The control module 107 is connected to the DIP switch module 106, the second voltage drop module 105, the auxiliary winding module 108 and the constant current driving module 103. Besides, the control module 107 outputs a pulse signal that corresponds to the electrical signal for controlling the constant current driving module 103. In addition, the control module 107 calculates the required voltage level for driving and determines the working status of the loading module 104 based on a voltage level relationship between the required voltage level and the actual voltage level.

In one embodiment, determining the loading module 104's working status according to the voltage level relationship between the required voltage value and the actual voltage value includes: (1) When the actual voltage value is lower than the required voltage value, the actual output power conforms to the required driving output power. Therefore, the control module 107 determines that the loading module 104 is under a normal working status. (2) When the actual voltage value is higher than the required voltage value, the actual output power is higher than the required driving output power. In this fashion, the control module 107 determines that the loading module 104 pauses its work.

In one embodiment, the power source 101 may be a direct current power source or an alternating current power source that is rectified to generate another direct current voltage to the first voltage drop module 102.

In one embodiment, the LED driver circuit includes a transformer T1. And the transformer T1 has a primary winding that is connected to the constant current driver module 103, and has a secondary winding that is connected to the loading module 104.

In one embodiment, the DIP switch module 106 selects a predetermined current level and then outputs an electrical signal to the control module 107. Also, the control module 107 converts the electrical signal from analog to digital. Such that the control module 107 identifies a current level set by the DIP switch module 106. Moreover, the control module 107 then calculates an actual output current and outputs a PWM signal that has a corresponding duty ratio. In this way, the control module 107 regulates a current that passes through the loading module 104. Meanwhile, the control module 107 calculates a required power that corresponds to the constant output power according to the predetermined current level set by the DIP switch module 106.

Figure 2:
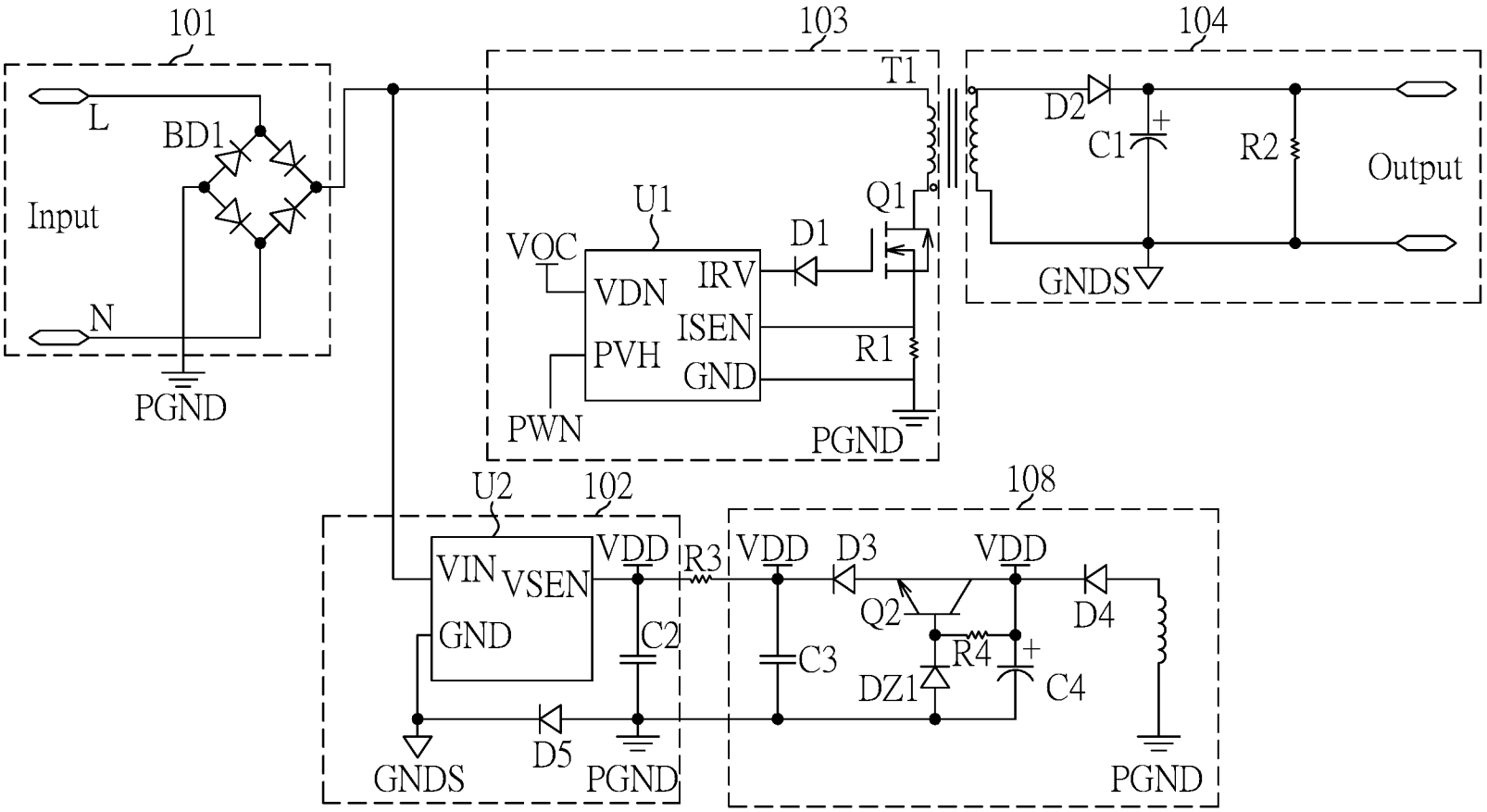
FIG. 2 illustrates how a first voltage drop module, an auxiliary winding module and a constant current driving module of a LED driver circuit are connected to a loading module according to one example.

FIG. 2 exemplarily demonstrates how the first voltage drop module 102, the auxiliary winding module 108, the constant driving module 103 are connected to the loading module 104 in the disclosed LED driver circuit according to one embodiment.

For clearer explanations, only partial descriptions that are related to the embodiment are described. The explanations are as follows:

In one embodiment, the first voltage drop module 102 includes a voltage drop chip U2, a second capacitor C2, and a fifth diode D5.

The voltage drop chip U2 has an input end that is connected to the power source 101.

The output end VSEN of the voltage drop chip U2 has an output end VSEN that is connected to the auxiliary winding module 108. Also, the second capacitor C2 has a first end that is connected to the auxiliary winding module 108.

The voltage drop chip U2 has a ground end GND that is connected to ground. In addition, the fifth diode device D5 has a negative end that is connected to ground.

The second capacitor C2 has a second end that is connected to the fifth diode device D5's positive end.

In one embodiment, the constant current driving module 103 includes a driver chip U1, a transistor Q1, a first diode D1 and a first resistor R1.

First, the driver chip U1 has an input end Vin that is connected to the first voltage drop module 102.

Second, the driver chip U1 has a control end PWM that is connected to the control module 107.

Third, the driver chip U1 has a driver end IRV that is connected to the first diode D1's negative end.

Fourth, the second diode D1's positive end is connected to the first transistor Q1's control end.

Fifth, the driver chip U1's output end ISEN, the first transistor Q1's input end, and the first resistor R1's first end are connected to each other.

Sixth, the driver chip U1's ground GND and the first resistor R1's second end are connected to ground.

The first transistor Q1's output end is connected to the loading module 104. Specifically, the first transistor Q1 may be a transistor or a field effect transistor. A collector end, an emitting end and a base end of the transistor are respectively the input end, the output end and the control end of the first transistor Q1. A drain end, a source end and a gate end of the field effect transistor are respectively the input end, the output end and the control end of the first transistor Q1.

In one embodiment, the auxiliary winding module 108 includes a third diode D3, a fourth diode D4, a third capacitor C3, a fourth capacitor C4, a fourth resistor R4, a Zener diode DZ1, a second transistor Q2 and an inductor P.

The third diode device D3's negative end, and the third capacitor C3's first end are connected to the first voltage drop module 102. The third diode device D3's positive end is connected to the second transistor Q2's output end. The second transistor Q2's control end, the Zener diode DZ1's negative end and the fourth resistor R4's first end are connected to each other. The second transistor Q2's input end, the fourth diode D4's negative end, the fourth resistor R4's second end, and the fourth capacitor C4's first end are connected to each other. The third capacitor C3's second end, the Zener diode DZ1's positive end, and the fourth capacitor C4's second end are connected to each other. The fourth diode D4's positive end is connected to ground via the inductor P. Specifically, the second transistor Q2 may be a transistor or a field effect transistor. The collecting end, the emitting end and the base end of the transistor are respectively an input end, an output end and a control end of the second transistor Q2. The drain end, the source end and the gate end of the field effect transistor are respectively the input end, the output end and the control end of the second transistor Q2.

Figure 3:
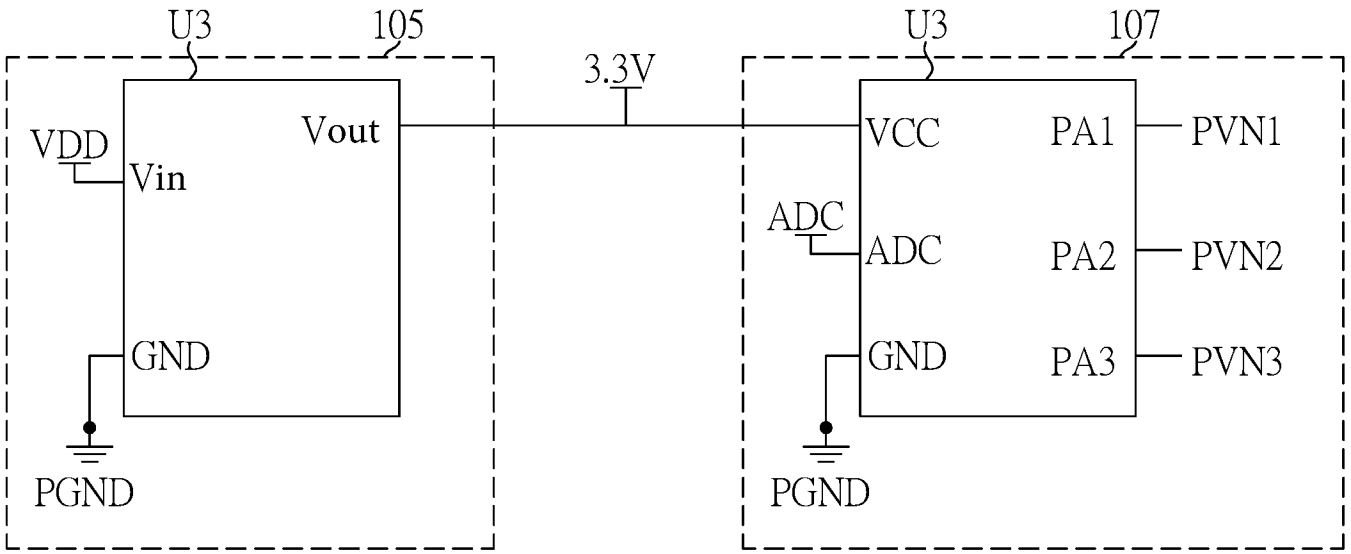
FIG. 3 exemplarily illustrates a second voltage drop module of a LED driver circuit is connected to a control module according to one example.

FIG. 3 demonstrates how the second voltage drop module 105 is connected to the control module 107 in the disclosed LED driver circuit according to one embodiment. For clearer explanations, only partial descriptions related to the embodiment is described. The detailed explanations are as follows:

In one embodiment, the second voltage drop module 105 includes a voltage drop chip U3. The voltage drop chip U3's input end Vin is connected to the first voltage drop module 102. The voltage drop chip U3's output end Vout is connected to the DIP switch module 106. The voltage drop chip U3's ground end GND is connected to ground.

In one embodiment, the control module 107 includes a main control chip U4. The main control chip U4's input end VCC is connected to the second voltage drop module 105. The main control chip U4's first receiver end PA2 and second receiver end PA3 are connected to the DIP switch module 106. The main control chip U4's control end PA1 is connected to the constant driving module 103. The main control chip U4's input end ADC is connected to the auxiliary winding module 108. The main control chip U4's ground end GND is connected to ground.

Figure 4:
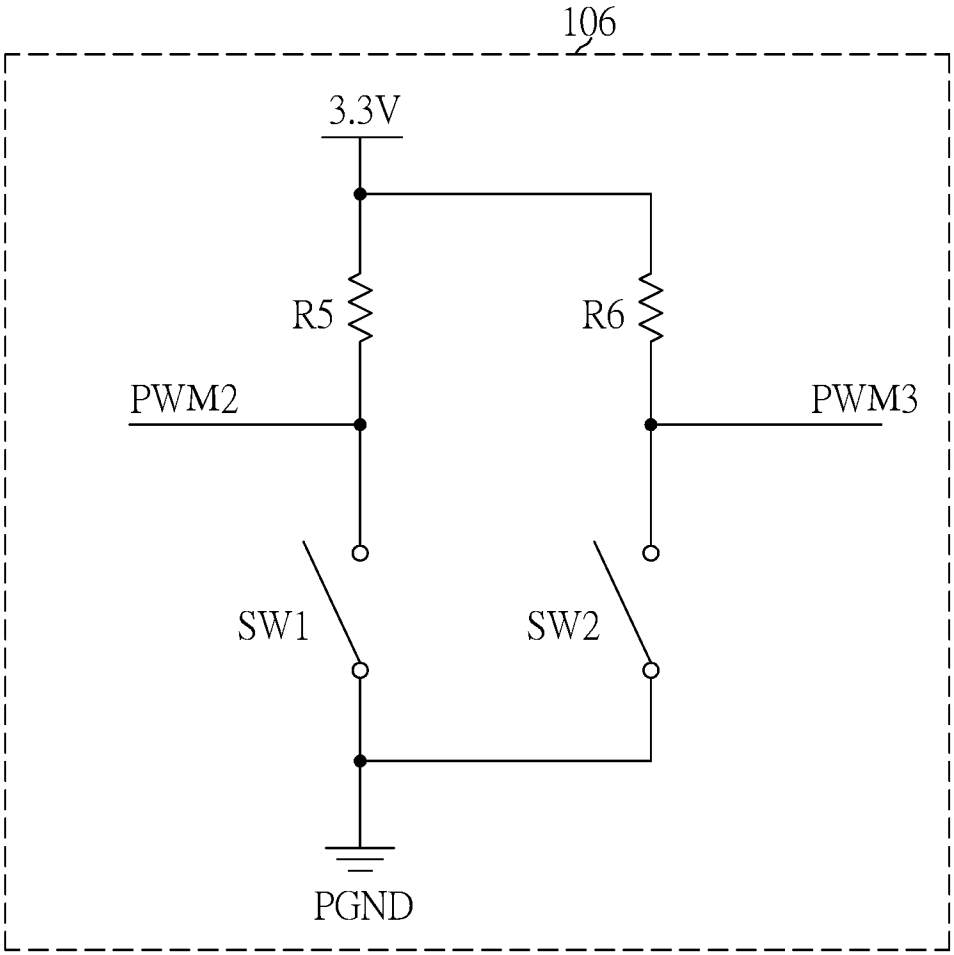
FIG. 4 exemplarily illustrates a DIP switch module of a LED driver circuit according to one example.

FIG. 4 exemplarily demonstrates the DIP switch module 106 in detail in the disclosed LED driver circuit according to one embodiment. For clearer explanations, only partial descriptions that are related to the embodiment are shown. The detailed explanations are as follows:

In one embodiment, the DIP switch module 106 includes a fifth resistor R5, a sixth resistor R6, a first DIP switch SW1 and a second DIP switch SW2. The fifth resistor R5's first end and the sixth resistor R6's first end are connected to the second voltage drop module 105. The fifth resistor R5's second end and the first DIP switch SW1's first end are connected to the control module 107. The sixth resistor R6's second end and the second DIP switch SW2's first end are connected to the control module 107. The first DIP switch SW1's second end and the second DIP switch SW2's second end are connected to ground.

The present invention also discloses a driver device that includes a loading module 104 and the above-disclosed LED driver circuit. Specifically, as shown in FIG. 2, the loading module 104 includes a second diode D2, a first capacitor C1, a second resistor R2, and a light emit diode LED. The second diode D2's positive end is connected to the constant current driving module 103. The second diode D2's negative end, the first capacitor C1's first end, and the second resistor R2's first end are connected to the light emit diode LED's first end. The first capacitor C1's second end and the second resistor R2's second end are connected to the light emit diode LED's second end.

According to descriptions related to FIGS. 1-4, how the disclosed LED driver circuit and the disclosed driver device work is depicted as follows.

After the first voltage drop module 102 bucks the direct current voltage, the constant current driving module 103 forwards the bucked direct current voltage to drive the loading module 104.

Meanwhile, after the second voltage drop module 105 bucks the bucked direct current voltage again, the second voltage drop module 105 provides a stable operating voltage to the control module 107 and the DIP switch module 106 via the double-bucked direct current voltage.

The DIP switch module 106 selects a required output current level and sets a corresponding amount of DIPs that correspond to the required output current level. For example: one DIP switch controls two levels of currents, and N DIP switches control 2^N (i.e., 2 to the power of N) levels of currents, where N is a positive integer.

The DIP switch module 106 includes a DIP switch and a pull-up resistor. A common end of the DIP switch and the pull-up resistor is used for outputting signals. When the DIP switch is turned on, the common end outputs a low electrical level. Also, when the DIP switch is turned off, the common end outputs a high electrical level. The DIP switch module 106's PWN (IN) end is connected to the control module 107's PWN (IN) end. Through high and low electrical levels input by the PWM(IN) end, a desired current level is determined.

The control module 107 calculates using both a maximal output current and the current level signal input by the DIP switch module 106 to generate a PWM signal. Via the control module 107's PWM (OUT) end, the PWM signal is transmitted to the constant current driving module 103 for outputting a corresponding current level. Meanwhile, based on the control module 107 calculates a maximal output voltage level Vmax that corresponds to a constant output power according to the current level selected by the DIP switch module 106.

After connecting to the loading module 104, the auxiliary winding module 108 is connected to the control module 107's ADC end.

The control module 107 converts the input voltage at its ADC end from analog to digital. Also, the control module 107 calculates the driving output voltage level Vout and compares the driving output voltage level Vout with the maximal output voltage Vmax.

If the actual loading voltage level Vout fails to exceed the maximal output voltage Vmax, it indicates that the actual output power conforms to the required output power. Such that the loading module 104 operates normally. If the actual loading voltage level Vout exceeds the maximal output voltage Vmax, it indicates that the actual output power is higher than the required output power. Such that the loading module 104 pauses its operation.

Therefore, the DIP switch module 106 regulates the output current. In addition, the regulated output current automatically matches the corresponding output voltage. Such that the driving constant output power stays constant.

In this way, the disclosed LED driver circuit has various types of luminance loading constant output power that cover lighting apparatuses of multiple types of serial connections and in turn relieve clients' burdens in dealing with more driving models.

To sum up, the disclosed LED driver circuit and the disclosed driver device that includes a first voltage drop module, a constant current driving module, a second voltage drop module, a DIP switch module, an auxiliary winding module, a control module and a loading module.

A direct current voltage is converted to drive the loading module. The converted direct current voltage is then bucked to generate an optimized voltage for powering the DIP switch module and the control module. The DIP switch module selects the predetermined current level and correspondingly outputs the electrical signal to the control module. Such that the control module outputs the corresponding pulse signal to regulate the current that passes through the loading module.

Meanwhile, the control module calculates the required voltage level for driving. Also, the control module compares the required voltage level with the actual voltage level output by the auxiliary winding module to determine the working status of the loading module. Therefore, various current levels can be regulated to drive different types of LED lighting apparatuses, and it leads to a broader range of applications.

The disclosed driver circuit and the disclosed driver device additionally determine the output loading voltage for keeping the output power stable. In this fashion, the disclosed driver circuit and the disclosed driver device relieves the conventional LED driving circuit of its driving limit that comes from a smaller driving output power and an accompanying lower driving power.

Those skilled in the art will readily observe that numerous modifications and alterations of the device and method may be made while retaining the teachings of the invention. Accordingly, the above disclosure should be construed as limited only by the metes and bounds of the appended claims.

The invention claimed is:

1. A driver device, comprising:

a loading module;

a first voltage drop module, connected to a power source to convert a direct current voltage;

a constant current driving module, connected to the first voltage drop module to receive the converted direct current voltage to drive the loading module;

an auxiliary winding module, connected to the first voltage drop module and the constant current driving module to receive the converted direct current voltage;

a second voltage drop module, connected to the first voltage drop module to buck the converted direct current voltage and to correspondingly output an optimized voltage;

a DIP switch module, connected to the second voltage drop module to receive the optimized voltage to select a predetermined current level, and to output an electrical signal;

a control module, connected to the DIP switch module, the second voltage drop module and the auxiliary winding module; and the constant current driving module, connected to the first voltage drop module, the auxiliary winding module and the control module to calculate a required driven voltage and to determine a working status of the loading module based on a voltage level relationship between the required driven voltage and an actual voltage level;

wherein the control module outputs a corresponding pulse signal that corresponds to the electrical signal for controlling the constant current driving module.

2. The driver device of claim 1, wherein the first voltage drop module comprises a voltage drop chip having an input end connected to the power source, an output end connected to the auxiliary winding module, and a ground end connected to ground, a second capacitor having a first end connected to the auxiliary winding module and a fifth diode device having a negative end connected to ground, and a positive end connected to a second end of the second capacitor.

3. The driver device of claim 1, wherein the second voltage drop module comprises a voltage drop chip having an input end connected to the first voltage drop module, an output end connected to the DIP switch module, and a ground end connected to ground.

* * * * *